US006988563B2

(12) United States Patent
Hashimoto et al.

(10) Patent No.: US 6,988,563 B2
(45) Date of Patent: Jan. 24, 2006

(54) HAMMER DRILL

(75) Inventors: Kouichi Hashimoto, Hikone (JP); Masahide Shiratani, Hikone (JP); Mineaki Yokoyama, Hikone (JP); Yoshikazu Okada, Yasu-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/648,615

(22) Filed: Aug. 26, 2003

(65) Prior Publication Data

US 2004/0074653 A1 Apr. 22, 2004

(30) Foreign Application Priority Data

Aug. 27, 2002 (JP) ..... 2002-247831

(51) Int. Cl.
*B25D 16/00* (2006.01)

(52) U.S. Cl. ..... 173/48; 173/109; 173/201

(58) Field of Classification Search ..... 173/48, 173/104, 109, 201, 205; 74/325, 60
See application file for complete search history.

(56) References Cited

U.S. PATENT DOCUMENTS

| | | | | |
|---|---|---|---|---|
| 3,834,468 A | | 9/1974 | Hettich et al. | 173/48 |
| 3,874,460 A | | 4/1975 | Schmid et al. | 173/109 |
| 4,236,588 A | * | 12/1980 | Moldan et al. | 173/48 |
| 4,280,359 A | * | 7/1981 | Schmid et al. | 173/48 |
| 4,506,743 A | * | 3/1985 | Grossmann | 173/48 |
| 4,537,264 A | * | 8/1985 | Schmid et al. | 173/48 |
| 5,125,461 A | * | 6/1992 | Hoser | 173/48 |
| 6,035,945 A | * | 3/2000 | Ichijyou et al. | 173/48 |
| 6,192,996 B1 | * | 2/2001 | Sakaguchi et al. | 173/48 |
| 2001/0052417 A1 | | 12/2001 | Neumaier | 173/48 |

FOREIGN PATENT DOCUMENTS

| | | |
|---|---|---|
| DE | 1 101 570 A2 | 5/2001 |
| JP | 2595262 | 4/1997 |

OTHER PUBLICATIONS

European Search Report dated Jan. 13, 2004, 4 pages.
English Translation of Japanese Patent No. 2595262 issued Apr. 2, 1997, 6 pages.

* cited by examiner

*Primary Examiner*—Scott A. Smith
(74) *Attorney, Agent, or Firm*—Osha-Liang LLP

(57) ABSTRACT

A hammer drill is equipped with a connector shaft, which is rotationally driven by a motor, a spindle that transmits the rotation through a connector shaft, and a percussive impact impact mechanism that applies a percussive force in the axial direction to a drill bit held by the spindle through performing a reciprocating motion, in the axial direction, relative to a spindle that receives the rotation of the connector shaft through a motion converter mechanism. The hammer drill is provided with a percussive force converter from the percussive impact impact mechanism by changing the speed reduction ratio between the motor and the connector shaft. This makes it possible to adjust the percussive force according to the drill bit used.

15 Claims, 10 Drawing Sheets

HAMMER DRILL

BACKGROUND OF INVENTION

The present invention relates to hammer drills used for, for example, boring concrete.

A hammer drill is a tool that applies a percussive impact to a drill bit in the axial direction while rotating the drill bit about its axis. The motion of a reciprocating piston propagates to a hammer, which is supported through an air spring, as the mechanism by which to provide the percussive impact. However, it is difficult to adjust the percussive force in hammer drills using this type of mechanism for providing the percussive impact, resulting in bent or broken drill bits when small drill bits are used. Conversely, when drill bits with larger diameters are used, with hammer drills with relatively small percussive forces, it is difficult to maintain the speed of the boring operations, causing the boring operations to be too time-consuming.

SUMMARY OF INVENTION

The present invention is a hammer drill comprising a connecting shaft driven rotationally by a motor, a spindle, to which the rotation is transmitted through the connector shaft, a percussive impact mechanism that applies a percussive force in the axial direction to a drill bit that is held by the spindle, and that reciprocates in the axial direction relative to the spindle, and that is rotated by the connector shaft via a motion converter mechanism, and a percussive force modification mechanism that modifies the percussive force from the percussive impact mechanism through modifying the reduction ratio between the motor and the connecting shaft. This makes it possible to adjust the percussive force according to the drill bit used.

The percussive force conversion mechanism is a transmission mechanism interposed between the motor and the connecting shaft where, in the transmission mechanism, preferably multiple gears that have mutually differing numbers of gear teeth, that can move freely in the axial direction of the connecting shaft, and that are rotated by receiving a rotational force from the motor, are preferably meshed selectively by the force of a spring, with the gear teeth equipped on the connecting shaft side, where the mating teeth of the, gear of that meshes with the teeth on the connecting shaft side are, preferably, equipped with a side wall on one side in the axial direction.

Furthermore, preferably the teeth on the connecting shaft side, or the mating teeth of the gear of that meshes with the gear teeth, have a different length in the axial direction for every other tooth, or, preferably, either the gear teeth on the connecting shaft side, or the mating teeth that mesh with the teeth, are equipped for every second tooth.

A sleeve is affixed to the connecting shaft, where the sleeve may be equipped with a gear and with a spring that applies a force to the gear.

Furthermore, the gear transmission mechanism is equipped with a shifting shaft for shifting between pairs of gears, making it possible to use, as appropriate, a mechanism wherein the shifting shaft is moved in the axial direction of the connecting shaft to separate one gear from the teeth on the connecting shaft side, pushing against the force of a spring, while another gear is moved by the force of the spring to a position wherein the gear meshes with the teeth on the connecting shaft side.

In one embodiment, this shifting shaft is equipped in a position that is off-center relative to the center of rotation of the shifting switch on the axis of the connecting shaft, and the position on the axis of the connecting shaft is changed by the shifting shaft rotating, for example, by 180°.

The pair of gears is not only equipped with a specific gap therebetween in the axial direction of the connecting shaft, but, preferably, there should be a space between the gears for obtaining a neutral state wherein neither gear meshes with the connecting shaft, and, more preferably, the equilibrium positions of the springs that exert forces on each of the gears in the pair, should be at the position of said neutral state.

DETAILED DESCRIPTION

Figure 1:
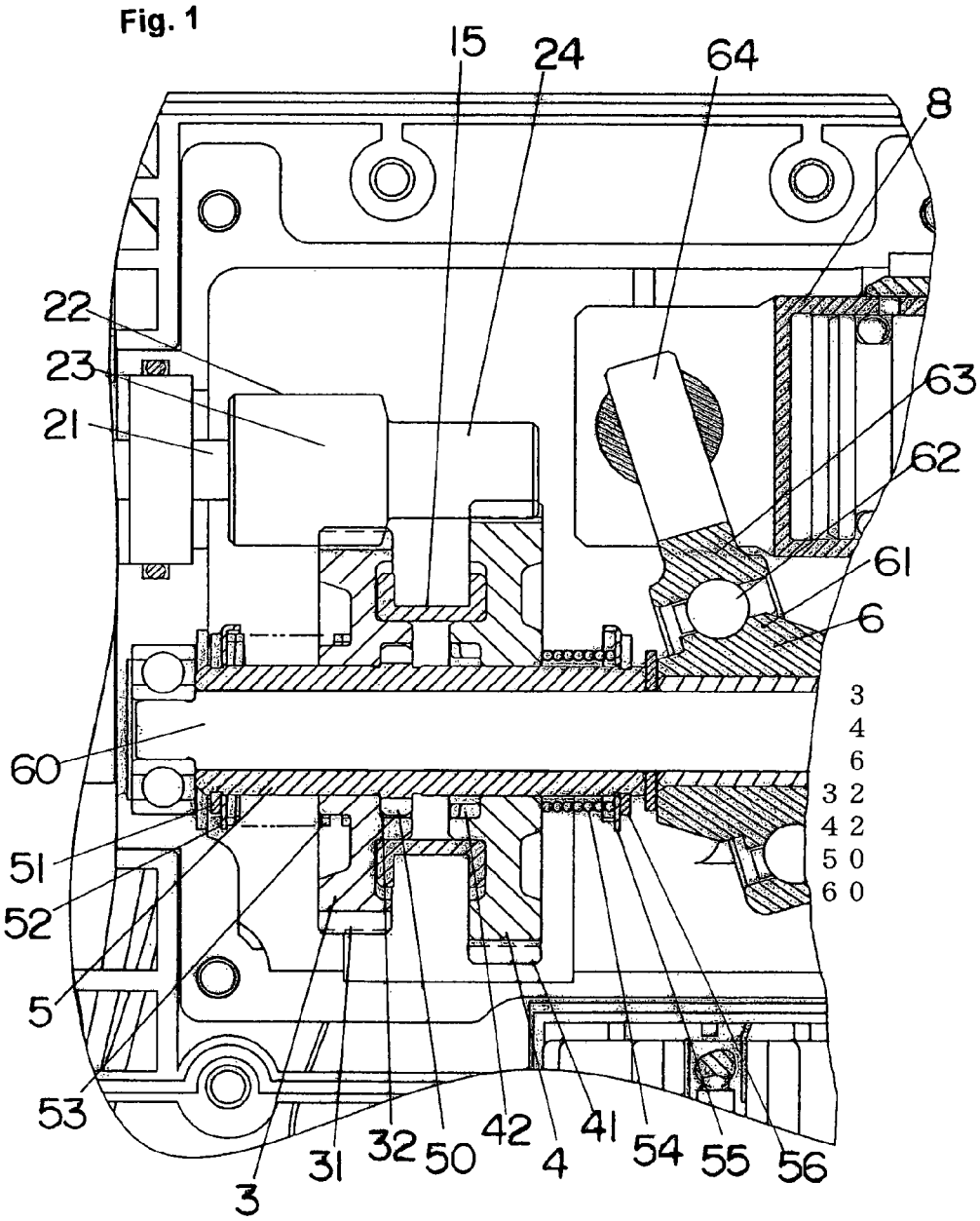
FIG. 1 is a partial cross-sectional drawing of a hammer drill according to an embodiment of the present invention.
Figure 2:
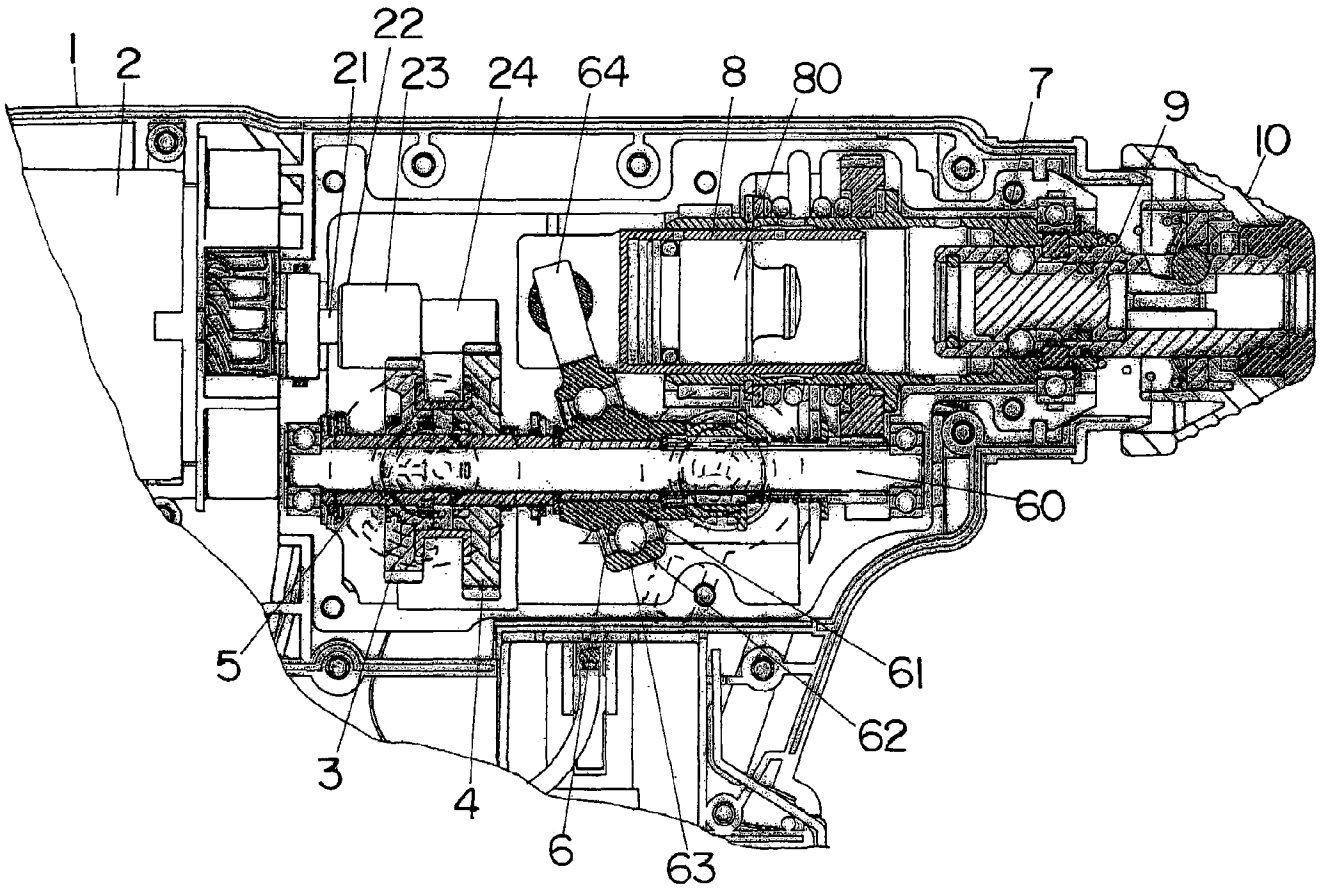
FIG. 2 is a cross-sectional drawing of a hammer drill according to an embodiment of the present invention.

An embodiment of the present invention will be explained in detail below, referencing the attached drawings. In the hammer drill shown in the figures, the rotation of the motor 2, as the motive source, equipped in a housing 1 is transmitted to a connecting shaft 60. As the rotation of the connecting shaft 60 is transmitted to an output shaft through a spindle 7, a piston 8, which is equipped so as to rotate freely on the axis thereof and which can slide freely in the axial direction relative to the spindle 7, is caused to undergo reciprocating motion by a motion converter mechanism equipped on the connecting shaft. The hammer 80, equipped within the piston 8, moves backward and forward in the space enclosed by the piston 8 and the spindle 7. The hammer 80 strikes against the back edge of the output shaft according to the reciprocating motion of the piston 8. Air chambers are formed in the forward and backward directions of the hammer 80, and act as springs.

The motion converter mechanism 6 comprises an inner race 61, which rotates as a unit with the connecting shaft 60, an outer race 63, which is equipped so as to rotate freely relative to the inner race 61, with ball bearings 62 interposed therebetween, and a rod 64, which protrudes from the outer race 63. The rod 64 is connected to the back end of the piston 8 through a universal joint, and the rotating surface of the outer race 63 that is a surface that is tilted relative to the axis of the connecting shaft 60. Consequently, when the connecting shaft 60 and the inner race 61 rotate, the outer race 63 and the rod 64 undergo reciprocating motion in the axial direction of the piston 8.

The front end of the output shaft 9 is equipped with a chuck 10 for housing a drill bit (not shown). The chuck 10 secures the drill bit. When the motor 2 rotates, at the same time as the drill bit is rotating due to the rotational forces transmitted to the output shaft through the spindle 7, there is also a percussive impact applied in the axial direction by the hammer 80.

The transmission of the rotational forces from the motor 2 to the connection shaft 9 in this embodiment is done through a two-stage transmission, as explained below. As is shown in FIG. 1, a pinion 22 equipped with a large diameter part 23 and a small diameter part 24 is attached to the axle 21 of a motor 2. Additionally, a gear 3, which meshes with the large diameter part 23 of the pinion 22, and the gear 4, which meshes with a small diameter part 24 of the pinion 22, are equipped on the connecting shaft 60 via a sleeve 5.

The sleeve 5 is secured on the connecting shaft 60. On the other hand, the gears 3 and 4 equipped with a specific gap in the axial direction are equipped so as to be able to slide freely in the axial direction of the sleeve, and equipped so as to be able to rotate freely relative to the sleeve 5. There is a ring-shaped collar 15 equipped between the gears 3 and 4, and there is a stop ring 51 equipped on one end of the sleeve 5. Furthermore, a stop ring 56 is equipped at the other end of the sleeve 5. Between a spring bearing 55 and the gear 4, there is a spring 54, which provides a force on the gear 4 towards the gear 3.

Gear teeth 50 are equipped on the outer peripheral surface of the sleeve 5 in the region near the center in the actual direction. The inner peripheral part of the gear 3 on the gear 4 side is equipped with mating teeth 32 that mesh with the gear teeth 50, and the inner peripheral part of the gears 4 on the gear 3 side are equipped with mating teeth 42, which mesh with the gear teeth 50.

Figure 3:
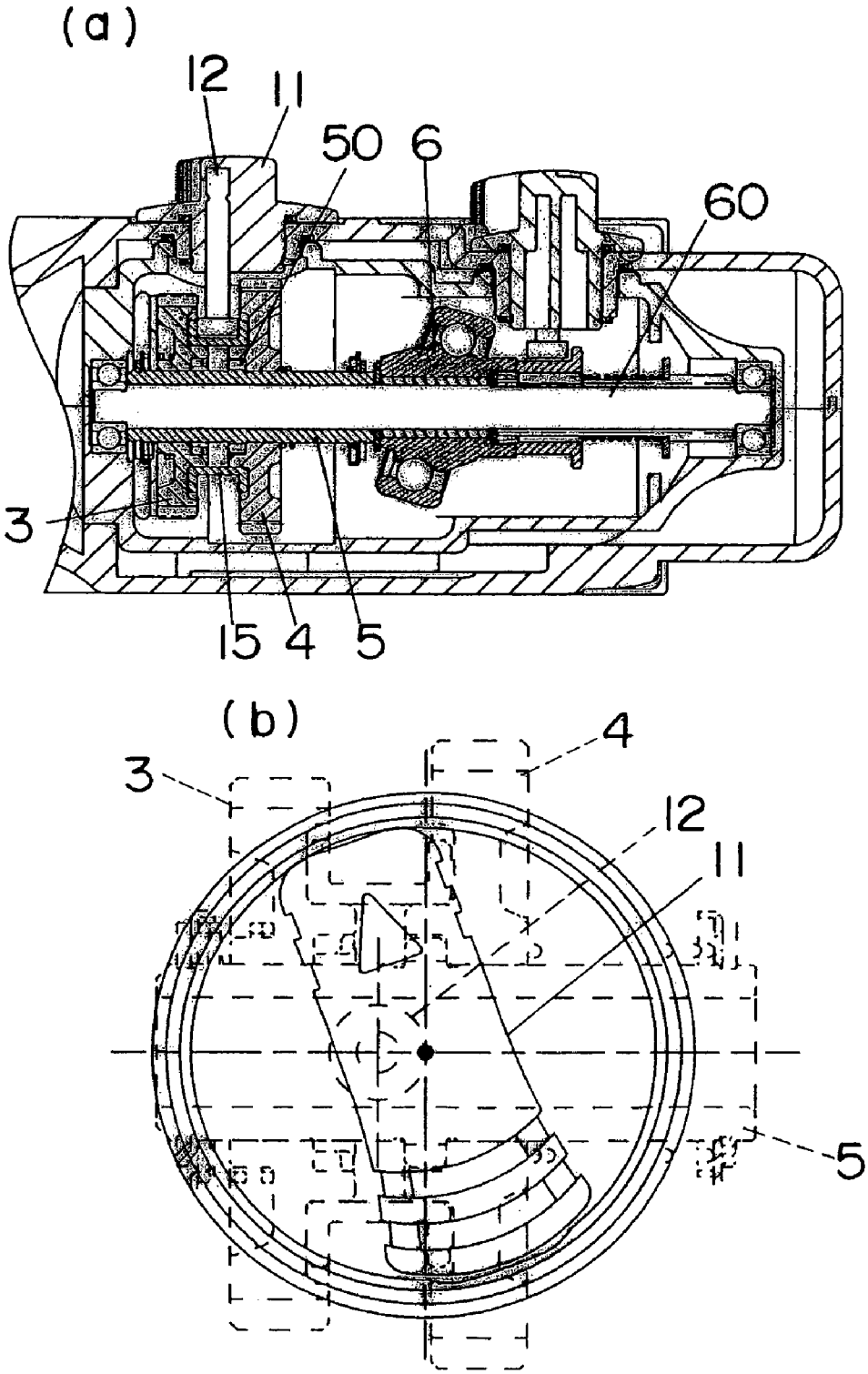
FIG. 3A is a partial cross-sectional drawing of a hammer drill in the state wherein the reduction ratio is small.
FIG. 3B is a drawing showing the state of the shifting switch in the state wherein the reduction ratio is low.

The mating teeth 32 of the gear 3 and the mating teeth 42 of the gear 4 can mesh, selectively, with the gear teeth 50. At the position wherein the spring forces of the springs 53 and 54 are at equilibrium (see FIG. 4), the gear teeth 50 are at a position between the gears 3 and 4, and neither the gear 3 nor the gear 4 mesh with the gear teeth 50. When the gears 3 and 4 are moved in the backwards direction (towards the motor 2), then, as shown in FIG. 3, the mating teeth 42 of the gear 4 mesh with the gear teeth 50, and, conversely, when the gears 3 and 4 are moved in the forward direction (towards the motion converter mechanism 6), then, as shown in FIG. 1 and FIG. 5, the mating teeth 32 of the gear 3 mesh with the gear teeth 50.

Regardless of the direction of movement of the gears 3 and 4, they always mesh with the pinion 22, and are always driven by the rotation of the motor 2.

The aforementioned movement of the gears 3 and 4 in the axial direction is done through the operation of the shifting switch 11, equipped on the outer surface of the housing 1. This shifting switch 11 is equipped with a shifting shaft 12 at a position that is off-center from the center of rotation thereof. The tip of the shifting shaft 12 is linked to a collar 15. When the shifting shaft 12 is moved by a rotating operation relative to the shifting switch 11, one of the gears 3 (4) is pushed by the collar 15 to move against the spring 53 (42), while the other gear 4 (3) is moved following the other gear 3 (4), due to the force of the spring 54 (32) so that the mating teeth 42 (32) thereof or mesh with the gear teeth 50. In other words, the structure is such that the gear 3 (4), which is moved by the operation of the shifting switch 11, ceases to mesh with the gear teeth 50, and the force of the spring 54 (32) causes the gear 4 (3) to mesh with the gear teeth 50. In addition, the respective mating teeth 32 and 42 are equipped on the inside wall on the opposite wall side from the gear teeth 50. Because of this, when the mating teeth 32 or 42 mesh with the gear teeth 50, the same mating position in the axial direction is always maintained.

When, as a shown in FIG. 1 (or FIG. 5), when the mating teeth 32 of the gear 3, which meshes with the large diameter part 23 of the pinion 22, mesh with the gear teeth 50 of the sleeve 5, the rotation of the motor 2 is transmitted to the sleeve 5, and to the connecting shaft 60, at a low speed ratio. On the other hand, as is shown in FIG. 3, when the mating teeth 42 of the gear 4, which meshes with the small diameter part 24 of the pinion 22, mesh with the gear teeth 50 of the sleeve 5, the revolution of the motor 2 is sent to the sleeve 5, and to the connecting shaft 60, at a large transmission ratio. In this way, the modification of the state of rotation of the connecting shaft 60 changes the number of percussive impacts per unit time of the hammering that is performed by the receipt of the revolving motion of this connecting shaft 60 by the motion converter mechanism 6. Furthermore, because the maximum speed also changes when the piston 8 undergoes reciprocating motion, the acceleration that moves the hammer 80 is also changed, changing not only the number of percussive impacts, but changing the impact forces as well.

Because of this, when a drill bit with a large diameter is used, a large percussive force can be obtained through the rotation of the connecting shaft 60 at a high-speed by reducing the transmission ratio applied to the connecting shaft 60, while, on the other hand, when a drill bit with a small diameter is used, the percussive force can be reduced through reducing the state of rotation of the connecting shaft 60, through increasing the reduction ratio arriving at the connecting shaft 60. Consequently, even if a drill bit with a small diameter is used, it is possible to avoid problems with the drill bit bending or breaking.

Figure 4:
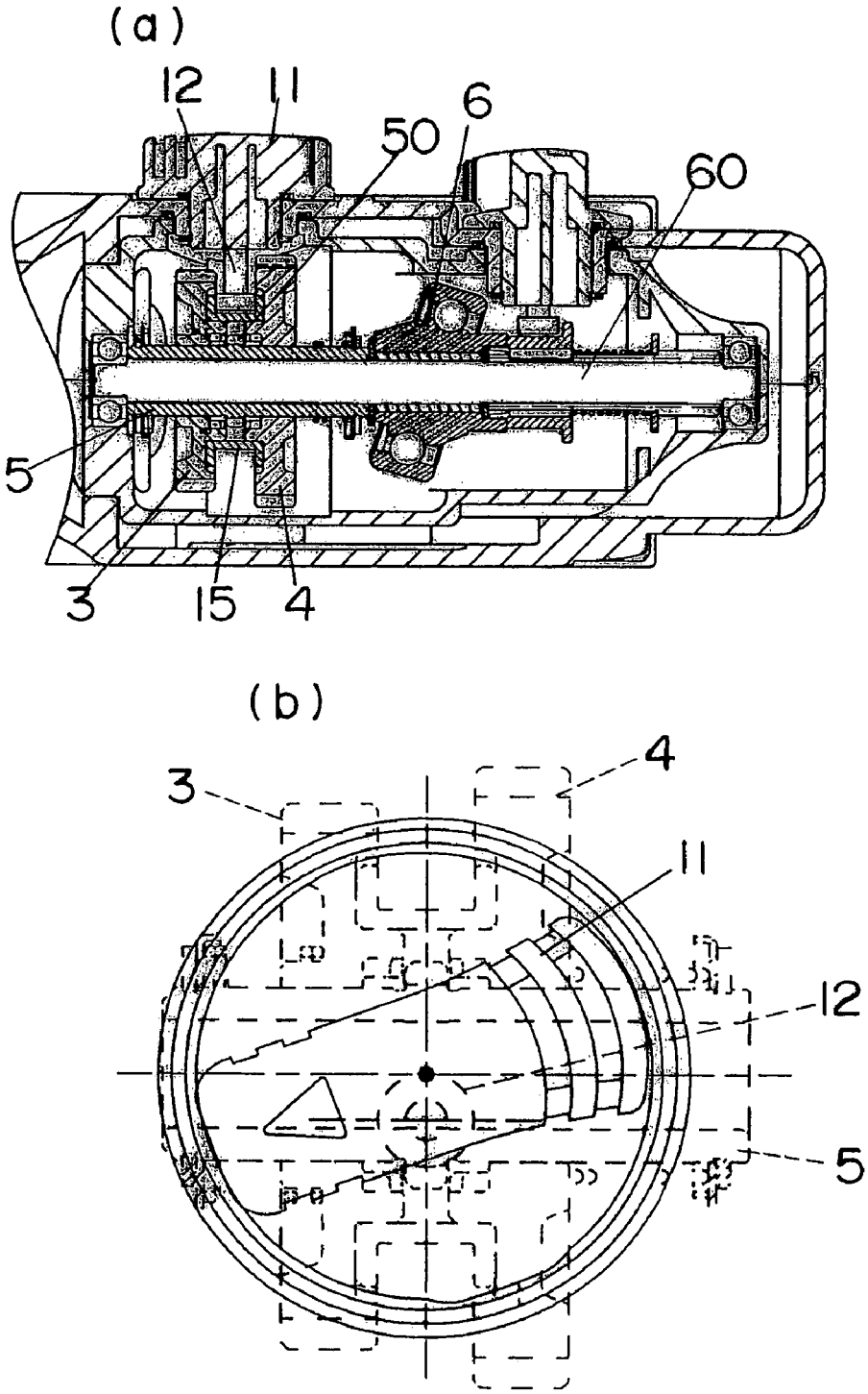
FIG. 4A is a partial cross-sectional drawing of a hammer drill in the neutral state.
FIG. 4B is a drawing showing the state of the shifting switch in the neutral state.
Figure 5:
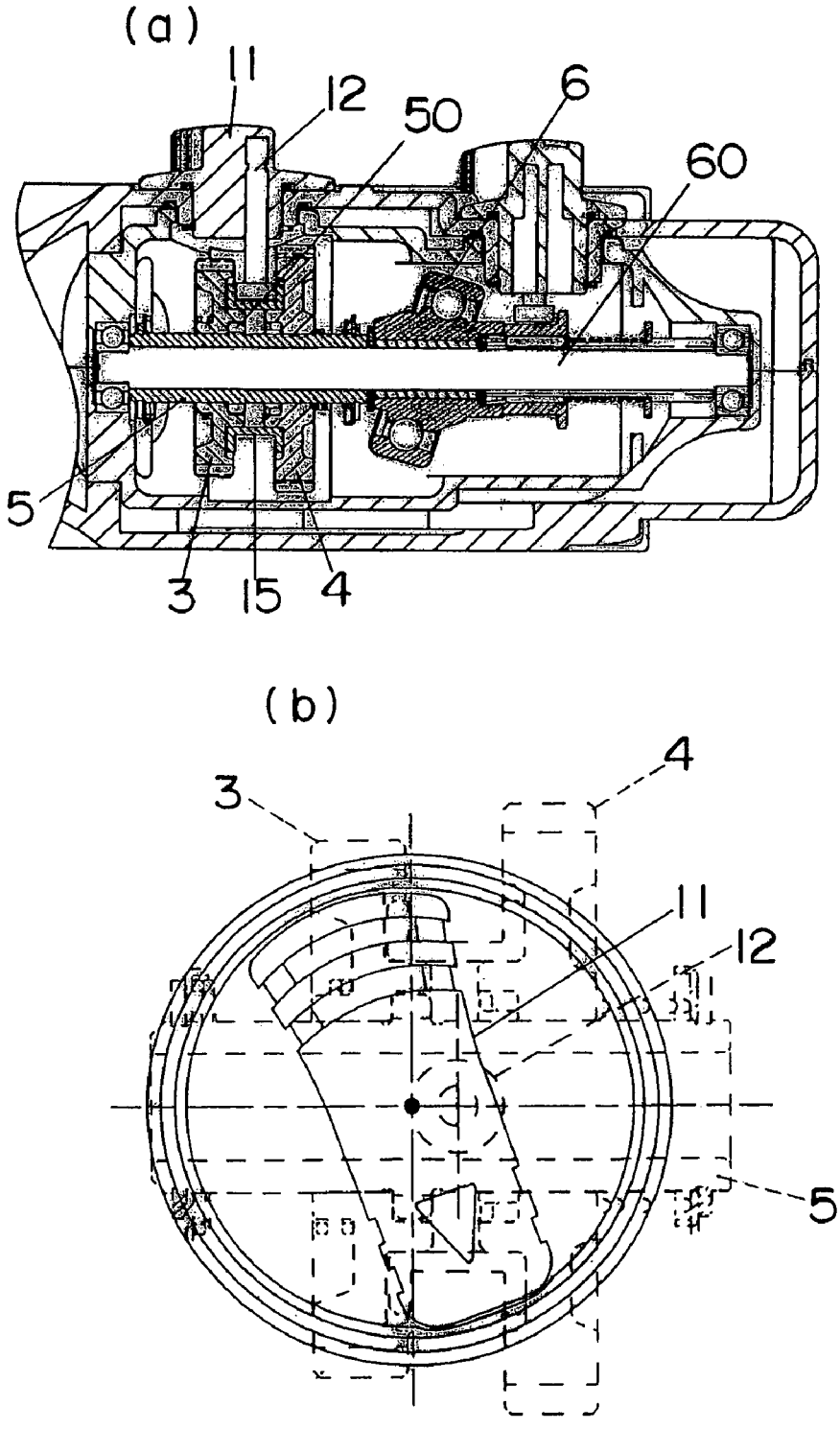
FIG. 5A is a partial cross-sectional drawing of a hammer drill in the state wherein the reduction ratio is large.
FIG. 5B is a drawing for explaining the state of the shifting switch in the state wherein the reduction ratio is large.

As is clear from FIGS. 3 to 5, not only does the center of rotation of the shifting switch 11 pass-through the center axle of the sleeve 5, but the shifting shaft 12, where having either gear 3 or the gear 4 of meshes with the gear teeth 50 of the sleeve 5 positioned on the central axis of the sleeve 5 is to prevent the effects of component forces that tend to rotate the shifting switch 11.

Figure 7:
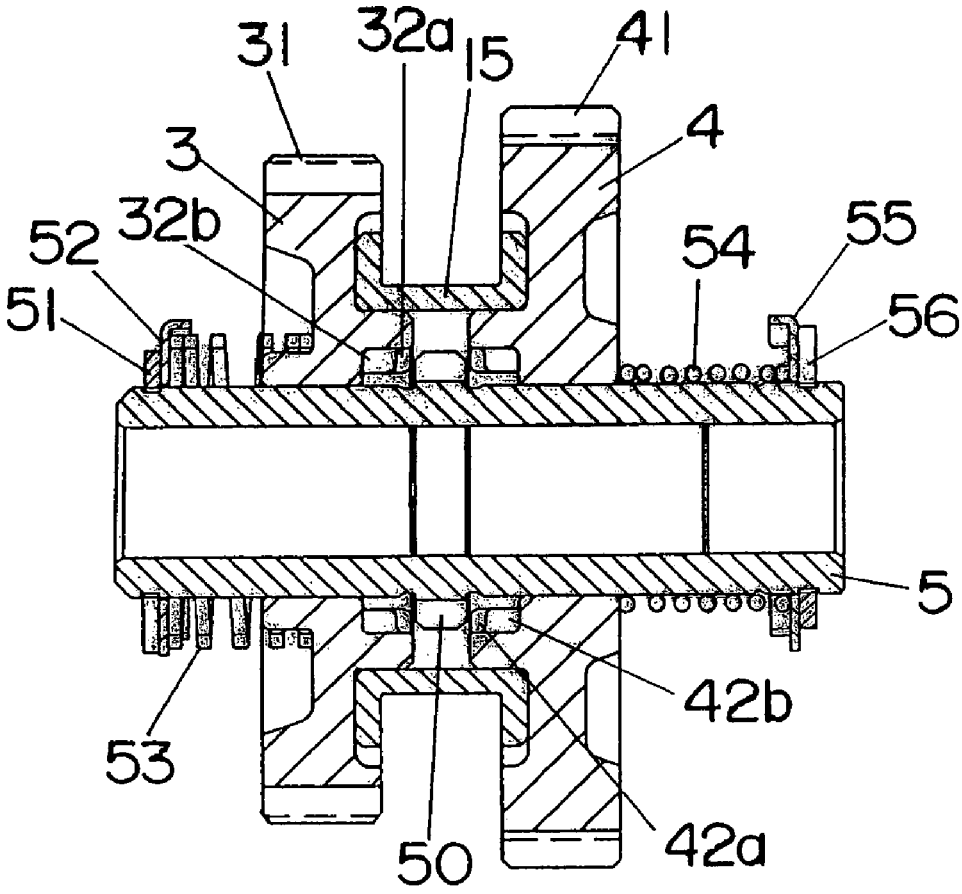
FIG. 7 is a cross-sectional drawing of the assembly block for changing speeds.

Furthermore, the fact that these forces off the springs 53 and 54 are in equilibrium at the neutral position shown in FIG. 4 and FIG. 7 not only improves the transmission characteristics, but also reduces the amount of force required for operating the shifting switch 11, ensuring that there is no disparity in the forces that must be applied in the operating direction.

Figure 6:
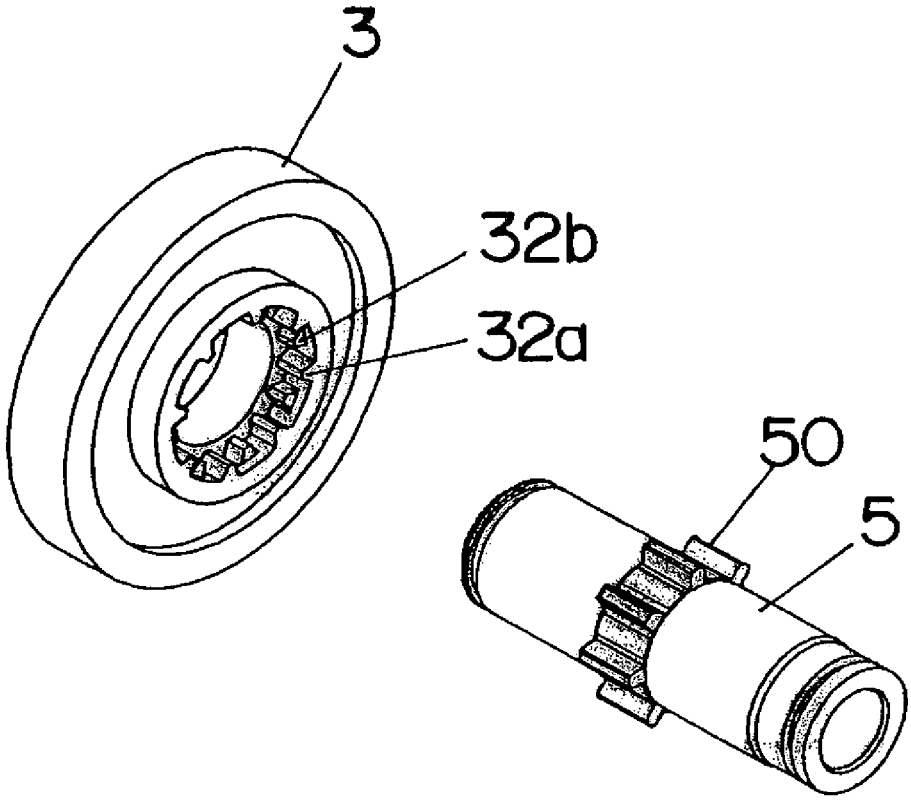
FIG. 6 is an oblique view of the sleeve and gear.

The mating teeth 32 of the gear 3 (as shown in FIG. 6) are structured from the mating teeth 32A, which are long in the axial direction, and mating teeth 32B, wherein a portion is cut away for the gear teeth 50, and so are short in the axial direction. The mating teeth 42 of the gear 4 also comprise the mating teeth 42A, which are long in the axial direction, and the mating teeth 42B, wherein a part is cut away for the gear teeth 50, and thus are short in the axial direction. Furthermore, there are half as many gear teeth 50 equipped on the outer peripheral surface of the sleeve 5 as there are mating teeth 32 or 42, so as to be placed in pairs therewith.

Figure 8:
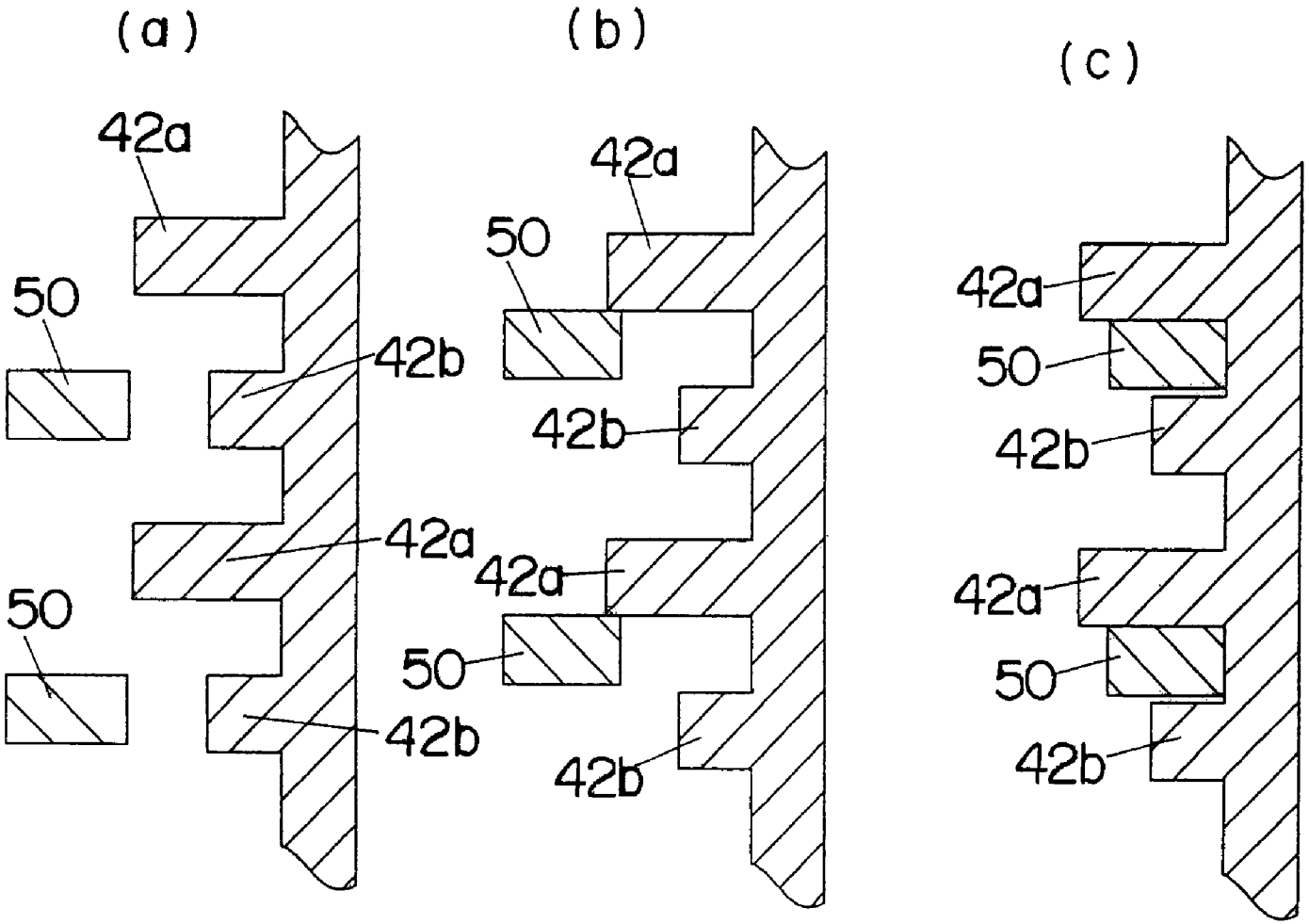
FIG. 8A to 8C are figures showing the meshing operations of the gears and sleeve.

This is for ease in meshing when, as shown in FIG. 8, the force of the spring 53 or spring 54 causes the rotating gear 3 or 4 to move to the gear teeth 50 side, as shown in FIG.

8, and, in order to reduce the chatter in the radial direction after the linkages complete. This structure not only makes it possible to perform the shifting operations smoothly, but also reduces the loss of percussive impact energy, maintaining the percussive performance.

Figure 9:
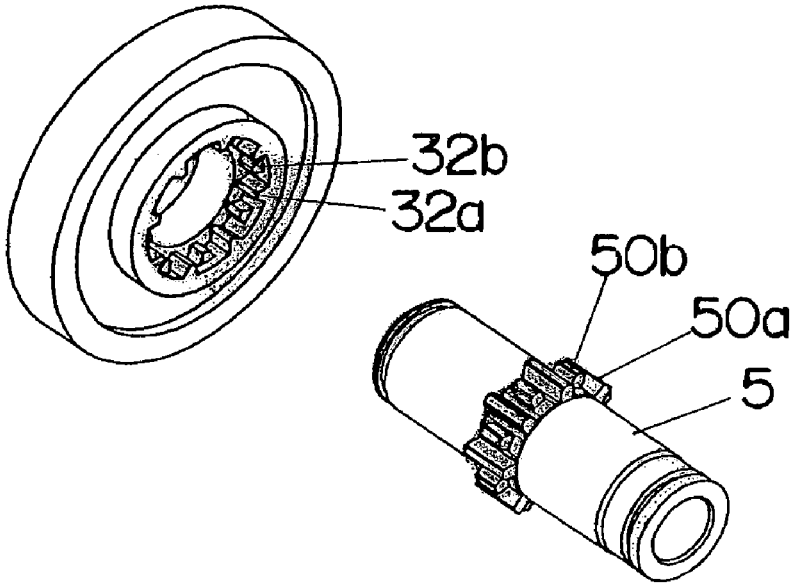
FIG. 9 is an oblique view of the sleeve and gears in an embodiment of the present invention.

In addition, as shown in FIG. 9, the gear teeth 50 may instead be equipped alternating between gear teeth 50A, which are long in the axial direction, and gear teeth 50B, wherein both ends in the axial direction are cut away so that the gear teeth are short in the axial direction. In this case, the mating teeth 32 and 42 on the gear 3 and gear 4 side are structured from teeth with only a single length.

Note that each of the components are disposed appropriately in order to prevent the gear 4 from contacting the motion converter mechanism 6 and the piston 8 when an operation on the shifting switch 11 moves the gear 4 to the motion converter mechanism 6 side. Furthermore, the various members are disposed appropriately so that even if the gear 4 moves far enough towards the motion converter member 6 side that the spring 54, positioned between the gear 4 and the motion converter mechanism 6, is fully compressed with the coils touching each other, the gear 4 will not come into contact with the motion converter mechanism 6 nor with the piston 8.

The provision of the small diameter gear 3 on the motor 2 side, and the provision of the large diameter gear 4 on the motion converter mechanism 6 (piston 8) side is to make it possible to have a structure with a shape that balances the pinion 22 well, thus making it possible to maintain the precision of the oscillating movement, and possible to maintain, with ease, the wall thickness of the pressure bearing relative to the axle 21.

Figure 10:
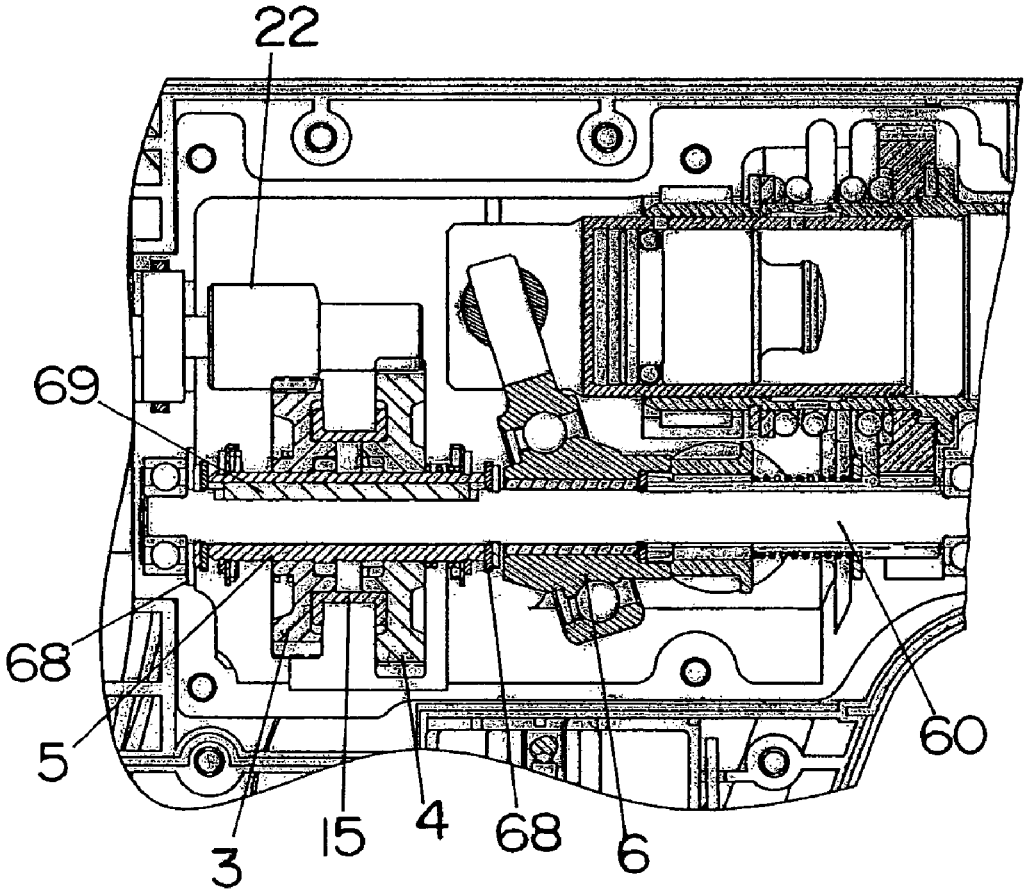
FIG. 10 is a cross-section of an embodiment of the present invention.

In the hammer drill according to the form of embodiment, the gears 3 and 4, which function as the transmission, the sleeve 5, the springs 53 and 43, and the spring 15 are structured as a single assembly block, as shown in FIG. 7. Consequently, as a shown in FIG. 10, merely attaching a key 69, for stopping the rotation relative to the connecting shaft 60, and stop rings 68 and 68 in order to prevent the axial direction movement, will be efficient in terms of assembly, as well.

As described above, given embodiments of the present invention, one or more of the benefits described below will be obtained:

In embodiments of the present invention, it is possible to change the percussive force for the drill bit, producing a small percussive force when using a small-diameter drill bit and producing a large percussive force when using a large diameter drill bit, thereby making it possible to ensure that the boring is always stable. Furthermore, in the present invention, the RPM can also be changed at the same time as changing the percussive force, and thus it is possible to reduce the electric current used when boring. Furthermore, even when the drill bit is clogged with cement dust, boring can still be performed with repeatability.

Given embodiments of the present invention, excellent gear-to-gear meshing is always maintained, and when the gear shift operations are performed when stopped, even when the gear is not meshed with the gear teeth in contact with the gear teeth on the connector shaft side, the gear teeth on the connector shaft side will mesh with the gear at the start of the rotation, making smooth gear shifting possible.

Furthermore, in embodiments of the present invention, the positioning of the gear teeth and of the mating gear teeth in the axial direction is simple.

In addition, in embodiments of the present invention, not only is the meshing operation of the gear with the connector shaft gear teeth done smoothly, but also, chattering in the radial direction is suppressed after meshing.

Furthermore, in embodiments of the present invention the structuring of the transmission mechanism as a single assembly block makes it easy to perform assembly and greatly suppresses costs.

Moreover, embodiments of the present invention has the shifting shaft of the shifting switch 11 positioned at an off-center position, and thus is able to avoid any unanticipated movement of the shifting switch due to reactive forces.

Furthermore, in embodiments of the present invention, a pair of gears is equipped with a specific gap in the axial direction therebetween, and a neutral state is formed wherein the gear teeth on the connector shaft do not meshed with either gear, making it possible to suppress the amount of grease (which is filled into the meshing part) that is thrown off.

Furthermore, in embodiments of the present invention, not only is it possible to perform the shifting operations and the shifting motion smoothly, but also the shifting operations can be performed through a relatively light operating force, and with the same operating force regardless of the direction of operation.

While the invention has been described with respect to a limited number of embodiments, those who skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A hammer drill for applying rotational forces and percussive forces to a drill bit, comprising:

a motor;

a percussive force converter mechanism driven rotationally by said motor for modifying percussive forces of said hammer drill by changing a rotational speed ratio of said motor and a connector shaft;

a connector shaft driven rotationally by said percussive force converter mechanism;

a spindle capable of holding said drill bit, wherein a rotational force through said connector shaft is propagated;

a motion converter mechanism for converting the rotational force of said connector shaft to a reciprocating force in an axial direction in said spindle; and a percussive member for applying a percussive force in an axial direction to the drill bit held in said spindle based on the reciprocating force converted by said motion converter mechanism, wherein said percussive force converter mechanism comprises a plurality of gears with mutually differing numbers of gear teeth, wherein the plurality of gears can move freely in an axial direction of said connector shaft, wherein a shifting switch selects a gear from the plurality of gears and the selected gear meshes, by a force of a spring, to gear teeth equipped on said connector shaft, and wherein mating teeth of a gear that mates with the gear teeth of said connector shaft side are provided with sidewalls on one side in an axial direction thereof.

2. A hammer drill according to claim 1, wherein one of the gear teeth on said connector shaft side and the mating teeth of said gear that meshes with said gear teeth have different axial-direction lengths on alternating teeth.

3. A hammer drill according to claim 1, wherein one of the gear teeth on said connector shaft side and the mating teeth of said gear that meshes with said gear teeth are provided every other tooth.

4. A hammer drill according to claim 1, wherein a sleeve is affixed to said connector shaft, wherein said sleeve is equipped with a spring that provides a force on said selected gear.

5. A hammer drill according to claim 1, wherein said percussive force converter mechanism is provided with a shifting shaft between a pair of gears, wherein, when said shifting shaft is moved in the axial direction of said connector shaft to remove one gear, against the force of the spring, away from the gear teeth of said connector shaft side, a second gear is moved by the force of a spring to a position where the second gear meshes with the gear teeth on the connector shaft side.

6. A hammer drill according to claim 5, wherein said shifting shaft is disposed off-center relative to a center of rotation of a shifting switch on the axis of said connector shaft.

7. A hammer drill according to claim 5, wherein said pair of gears is equipped with a specific gap in the axial direction of said connector shaft, and a space for obtaining a neutral state in which none of the pair of gears meshes with the gear teeth on said connector shaft side is formed between said pair of gears.

8. A hammer drill according to claim 7, wherein equilibrium positions of the springs that provide forces onto each of the gears of said pair of gears is in the position of said neutral state.

9. A hammer drill comprising:

a motor;

a transmission mechanism driven rotationally by said motor;

a connector shaft driven rotationally by said transmission mechanism, wherein said transmission mechanism is configured to change a rotational speed ratio between said motor and said connector shaft;

a spindle having a chuck to hold a drill bit, configured to rotate by a rotational force through said connector shaft;

a motion converter mechanism configured to convert the rotational force of said connector shaft to a reciprocating force in an axial direction of said spindle; and a percussive member configured to reciprocate in an axial direction of said spindle based on the reciprocating force converted by said motion converter mechanism, wherein said spindle is percussed by the percussive member, while rotating based on the rotational force through said connector shaft, wherein said transmission mechanism comprises:

a plurality of gears of different diameters which can move in the axial direction along said connector shaft;

gear teeth provided around said connector shaft;

wherein one of said plurality of gears selectively meshes with said gear teeth of said connector shaft by a force of a spring, and wherein said plurality of gears are configured to concentrically rotate on said connector shaft.

10. A hammer drill according to claim 9, wherein said transmission mechanism further comprises:

a pinion, having a plurality of gear portions in different diameters, provided on an axle of said motor, wherein the plurality of gears mesh respectively with the plurality of gear portions of said pinion.

11. A hammer drill according to claim 9, wherein each of said plurality of gears comprises inner gear teeth to be selectively meshed with said gear teeth of said connector shaft.

12. A hammer drill according to claim 9, wherein each of said plurality of gears is disposed at an interval in the axial direction of said connector shaft.

13. A hammer drill according to claim 12, wherein a gap for a neutral state that none of said plurality of gears meshes with said gear teeth of said connector shaft is formed between said plurality of gears.

14. A hammer drill according to claim 9, further comprising a spring disposed around said connector shaft for biasing said plurality of gears.

15. A hammer drill according to claim 9, further comprising a shifting switch operatively connected to said connector shaft, wherein one of said plurality of gears selectively meshes with said gear teeth of said connector shaft by operation of said shifting switch.

* * * * *